US010973379B2

(12) United States Patent
Krebs

(10) Patent No.: US 10,973,379 B2
(45) **Date of Patent: *Apr. 13, 2021**

(54) AGITATOR WITH DISKS

(71) Applicant: BISSELL Homecare, Inc., Grand Rapids, MI (US)

(72) Inventor: Alan J. Krebs, Pierson, MI (US)

(73) Assignee: BISSELL Inc., Grand Rapids, MI (US)

( * ) Notice: Subject to any disclaimer, the term of this patent is extended or adjusted under 35 U.S.C. 154(b) by 315 days.

This patent is subject to a terminal disclaimer.

(21) Appl. No.: 16/176,366

(22) Filed: Oct. 31, 2018

(65) Prior Publication Data

US 2019/0059665 A1 Feb. 28, 2019

Related U.S. Application Data

(63) Continuation of application No. 14/972,525, filed on Dec. 17, 2015, now Pat. No. 10,143,344.

(60) Provisional application No. 62/097,666, filed on Dec. 30, 2014.

(51) Int. Cl.

| | |
|---|---|
| ***A47L 5/30*** | (2006.01) |
| ***A47L 7/00*** | (2006.01) |
| ***A47L 9/04*** | (2006.01) |

(52) U.S. Cl.

CPC ..... *A47L 5/30* (2013.01); *A47L 7/0066* (2013.01); *A47L 9/0477* (2013.01)

(58) Field of Classification Search

CPC ..... A47L 5/30; A47L 7/0066; A47L 9/0477; A47L 11/4041

See application file for complete search history.

(56) References Cited

U.S. PATENT DOCUMENTS

| | | | |
|---|---|---|---|
| 2,324,272 | A | 7/1943 | Anderson |
| 2,407,408 | A | 9/1946 | Erickson |
| 2,476,537 | A | 7/1949 | Erickson |
| 3,084,367 | A | 4/1963 | Radinse |
| 3,090,062 | A | 5/1963 | Nelson |
| 3,109,190 | A | 11/1963 | Nelson |
| 3,643,281 | A | 2/1972 | Schofield |
| 4,138,756 | A | 2/1979 | Krier et al. |
| 4,159,555 | A | 7/1979 | Schneider |
| 8,533,905 | B1 | 9/2013 | Tran |
| 2006/0090291 | A1 | 5/2006 | Dever |
| 2006/0150352 | A1 | 7/2006 | Field |
| 2013/0206168 | A1 | 8/2013 | West et al. |

FOREIGN PATENT DOCUMENTS

| | | | |
|---|---|---|---|
| DE | 2652894 | B1 | 11/1976 |

OTHER PUBLICATIONS

Rhodri Evans, Further Search Report Under Section 17- Claims Search 15-19, dated Jan. 17, 2017, 1 page, Intellectual Property Office South Wales.

Rhodri Evans, Further Search Report Under Section 17- Claims Search 20 & 21, dated Jan. 17, 2017, 1 page, Intellectual Property Office South Wales.

*Primary Examiner* — David Redding

(74) *Attorney, Agent, or Firm* — McGarry Bair PC

(57) ABSTRACT

An agitator is provided for a surface cleaning apparatus, the agitator including a dowel. The dowel defines an axis of rotation. A plurality of disks extends radially from the dowel to a scalloped peripheral edge. The scalloped peripheral edge includes a series of curved recesses, the series of curved recesses extending inwardly toward the dowel.

20 Claims, 8 Drawing Sheets

AGITATOR WITH DISKS

CROSS REFERENCE TO RELATED APPLICATIONS

This application is a continuation of U.S. patent application Ser. No. 14/972,525, filed Dec. 17, 2015, now U.S. Pat. No. 10,143,344, issued Dec. 4, 2018, which claims the benefit of U.S. Provisional Patent Application No. 62/097,666, filed Dec. 30, 2014, both of which are incorporated herein by reference in their entirety.

BACKGROUND

Household pets, such as dogs and cats, tend to shed hair, which collects on carpets, furniture, and other areas of the home. A common complaint of pet owners is the seemingly never-ending battle to remove the pet hair. Pet hair and other similar debris can be relatively small and difficult to collect, even with conventional vacuum cleaners. Further, vacuum cleaners having rotating or otherwise moving agitators in the suction path to remove pet hair and other debris can collect hair and debris at the moving parts, thereby impeding the operation and effectiveness of the vacuum cleaner.

With a conventional agitator having a plurality of bristle tufts, hair tends to become wedged tightly between bristles in a conventional tufted bundle of bristles. The bundle of bristles in a tuft typically flare outwardly from the base of the tuft where the bristles are inserted into a dowel, to the outer trim diameter where the bristles spread out to some extent and are not packed as tightly together as they are at the base of the tuft. When a conventional tufted brush rotates, the outer portion of the tuft can contact hair on carpet fibers and the hair can become embedded between adjacent bristles. As the agitator rotates, the hair can be pulled toward the base of the tuft where adjacent bristles are more tightly packed together and ultimately wedged into the base of the tuft. As a result, the wedged hair is more difficult it is to remove from the tuft.

BRIEF DESCRIPTION

An aspect of the present disclosure relates to an agitator for a surface cleaning apparatus includes a dowel defining an axis of rotation and a plurality of disks extending radially from the dowel to a scalloped peripheral edge, the scalloped peripheral edge including a series of curved recesses extending inwardly toward the dowel, wherein the plurality of disks lie in oblique planes with respect to the axis of rotation.

Another aspect of the present disclosure relates to an agitator for a surface cleaning apparatus includes a dowel defining an axis of rotation and a plurality of disks extending radially from the dowel to a scalloped peripheral edge, the scalloped peripheral edge including a series of curved recesses extending inwardly toward the dowel, wherein the disks have a higher coefficient of friction than the dowel.

DETAILED DESCRIPTION

Aspects of the present disclosure relate to surface cleaning apparatus and in particular to vacuum cleaners, sweepers, or tools therefore, having a rotatable agitator. For purposes of description related to the figures, the terms "upper," "lower," "right," "left," "rear," "front," "vertical," "horizontal," and derivatives thereof shall relate from the perspective of a user in a typical operating position behind the vacuum cleaner, which defines the rear of the vacuum cleaner. However, it is to be understood that the aspects of the present disclosure may assume various alternative orientations, except where expressly specified to the contrary.

Figure 1:
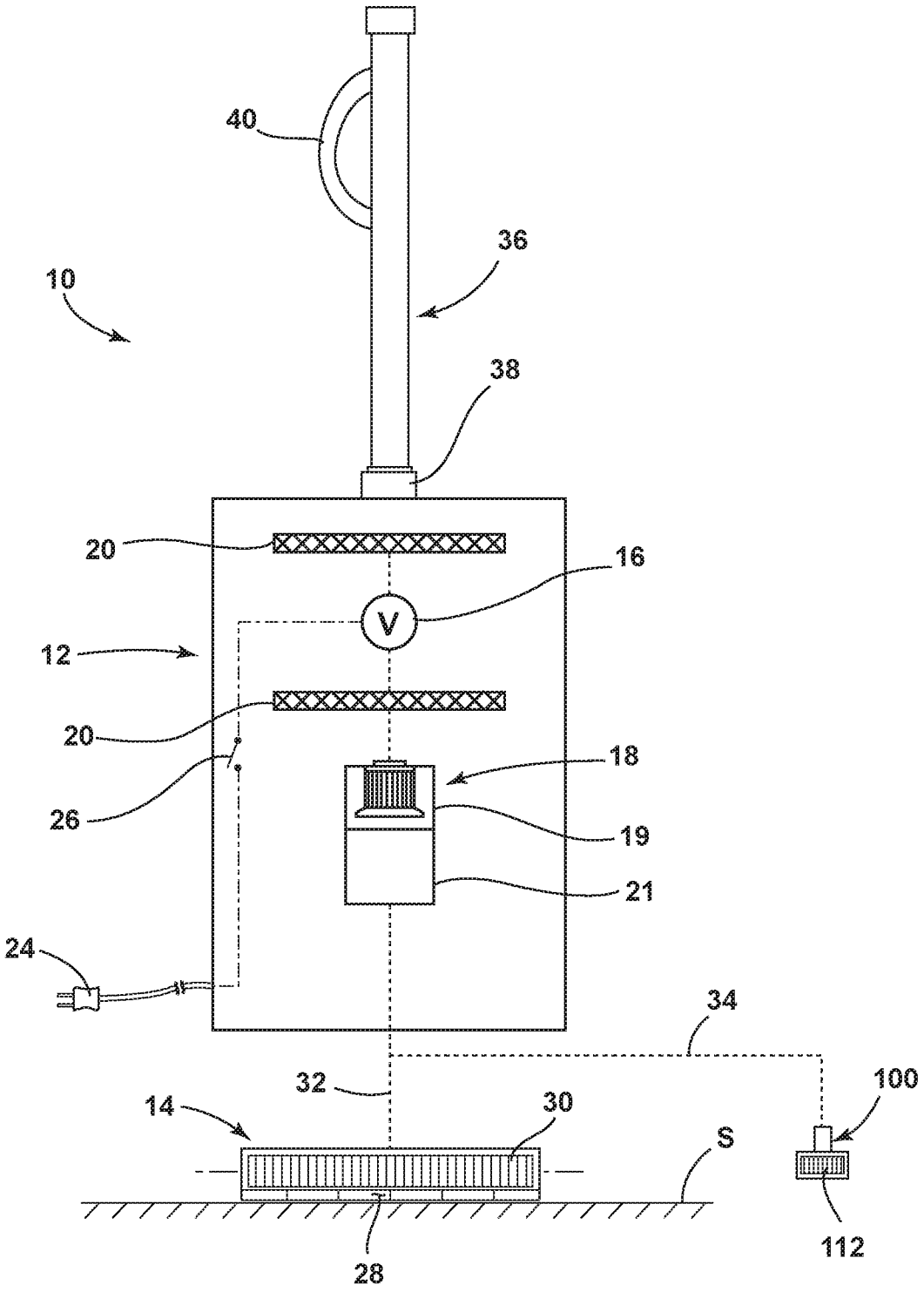
FIG. 1 is a schematic view of a vacuum cleaner according to an aspect of the present disclosure.

FIG. 1 is a schematic view of a vacuum cleaner 10 according to aspects of the present disclosure. The vacuum cleaner 10 can be configured as an upright-type vacuum cleaner, a canister-type vacuum cleaner, a stick vacuum cleaner, an autonomous or robotic vacuum cleaner, or a hand-held vacuum cleaner. Furthermore, the vacuum cleaner 10 can additionally be configured to distribute a fluid and/or to extract a fluid, where the fluid may for example be liquid or steam.

The vacuum cleaner 10 includes a housing 12 adapted for movement over a surface to be cleaner S. The housing 12 is provided with a vacuum separation and collection system for creating a partial vacuum to suck up debris (which may include dirt, dust, soil, hair, and other debris) from the surface to be cleaned S and collecting the removed debris in a space provided on the vacuum cleaner 10 for later disposal.

The vacuum separation and collection system includes a suction source 16 in fluid communication with a foot 14 for generating a working air stream and a separating and collection assembly 18 for separating and collecting debris from the working air stream for later disposal.

The housing 12 further comprises a handle 36 to facilitate movement of the vacuum cleaner 10 by a user. A handle coupler 38 can receive the proximal end of the handle 36, which may be fixed with respect to the housing 12. Alternatively, the handle coupler 38 may be configured to telescopically mount the proximal end of the handle 36 so that the handle 36 can be retracted or extended with respect to the housing 12. In yet another configuration, the handle coupler 38 may pivot such that the handle 36 can rotate or fold about a horizontal axis relative to the housing 12. A handle grip 40 may be provided on the distal end of the handle 36.

In one configuration illustrated herein, the collection assembly 18 can include a cyclone separator 19 for separating contaminants from a working air stream and a removable debris cup 21 for receiving and collecting the separated contaminants from the cyclone separator 19. The cyclone separator 19 can have a single cyclonic separation stage, or multiple stages. In another configuration, the collection assembly 18 can include an integrally formed cyclone separator 19 and debris cup 21, with the debris cup 21 being provided with a structure, such as a bottom-opening debris door, for contaminant disposal. It is understood that other types of collection assemblies 18 can be used, such as a centrifugal separator, a bulk separator, a filter bag, or a water-bath separator. The housing 12 can also be provided with one or more additional filters 20 upstream or downstream of the separating and collection assembly 18 or the suction source 16.

The suction source 16, such as a motor/fan assembly, is provided in fluid communication with the separating and collection assembly 18, and can be positioned downstream or upstream of the separating and collection assembly 18. The suction source 16 can be electrically coupled to a power source 24, such as a battery or by a power cord plugged into a household electrical outlet. A suction power switch 26 between the suction source 16 and the power source 24 can be selectively closed by the user upon pressing a vacuum power button (not shown), thereby activating the suction source 16. As shown herein, the suction source 16 is downstream of the separating and collection assembly 18 for a 'clean air' system; alternatively, the suction source 16 can be upstream of the separation and collection assembly 18 for a 'dirty air' system.

The housing 12 is provided with the foot 14 in communication with the suction source 16 via a working air conduit 32 for engaging and cleaning the surface to be cleaned S. The foot 14 includes a suction nozzle 28 and an agitator assembly 30. The agitator assembly 30 within the foot 14 is configured to agitate debris on the surface to be cleaned S so that the debris is more easily ingested into the suction nozzle 28. The suction nozzle 28 is formed at a lower portion of the foot 14 for fluid communication between the suction source 16 and the surface to be cleaned S. The agitator assembly 30 is rotatably positioned within the foot 14 adjacent the suction nozzle 28 for rotational movement, and can be coupled to and driven by a dedicated agitator motor provided in the foot 14 via a commonly known arrangement including a drive belt. Alternatively, the agitator assembly 30 can be coupled to and driven by the suction source 16 in the housing 12 or by a turbine or gear system. It is within the scope of the present disclosure for the agitator assembly 30 to be mounted within the foot 14 in a fixed or floating vertical position relative to the foot 14.

The housing 12 is further provided with an accessory tool 100 in communication with the suction source 16 via a working air conduit 34, such as a suction hose, for engaging and cleaning the surface to be cleaned S. The tool 100 includes a suction nozzle 106 and an agitator assembly 112. The agitator assembly 112 within the tool 100 is configured to agitate debris on the surface to be cleaned S so that the debris is more easily ingested into the suction nozzle 106. The suction nozzle 106 is formed for fluid communication between the suction source and the surface to be cleaned S. The agitator assembly 112 is rotatably positioned within the tool 100 adjacent the suction nozzle 106 for rotational movement, and can be coupled to and driven by the suction source 16 in the housing 12. Alternatively, the agitator assembly 112 can be coupled to and driven by a dedicated agitator motor provided in the tool 100 via a commonly known arrangement that can include a drive belt.

The vacuum cleaner 10 can be used to effectively clean the surface to be cleaned S by removing debris (which may include dirt, dust, soil, hair, and other debris) from the surface to be cleaned S in accordance with the following method. The sequence of steps discussed is for illustrative purposes only and is not meant to limit the method in any way as it is understood that the steps may proceed in a different logical order, additional or intervening steps may be included, or described steps may be divided into multiple steps, without detracting from the aspects of the present disclosure.

To perform vacuum cleaning, the suction source 16 is coupled to the power source 24 and draws in debris-laden air through one of the foot 14 or tool 100 and into the separating and collection assembly 18 via the working air conduits 32, 34 where the debris is substantially separated from the working air. The air stream then passes the suction source 16, and through any optional filters 20 positioned upstream and/or downstream from the suction source 16, prior to being exhausted from the vacuum cleaner 10. During vacuum cleaning, one of the agitator assemblies 30, 112 can agitate debris on the surface to be cleaned S so that the debris is more easily ingested into one of the suction nozzles 28, 106. The separating and collection assembly 18 can be periodically emptied of collected debris. Likewise, the optional filters 20 can periodically be cleaned or replaced.

Figure 2:
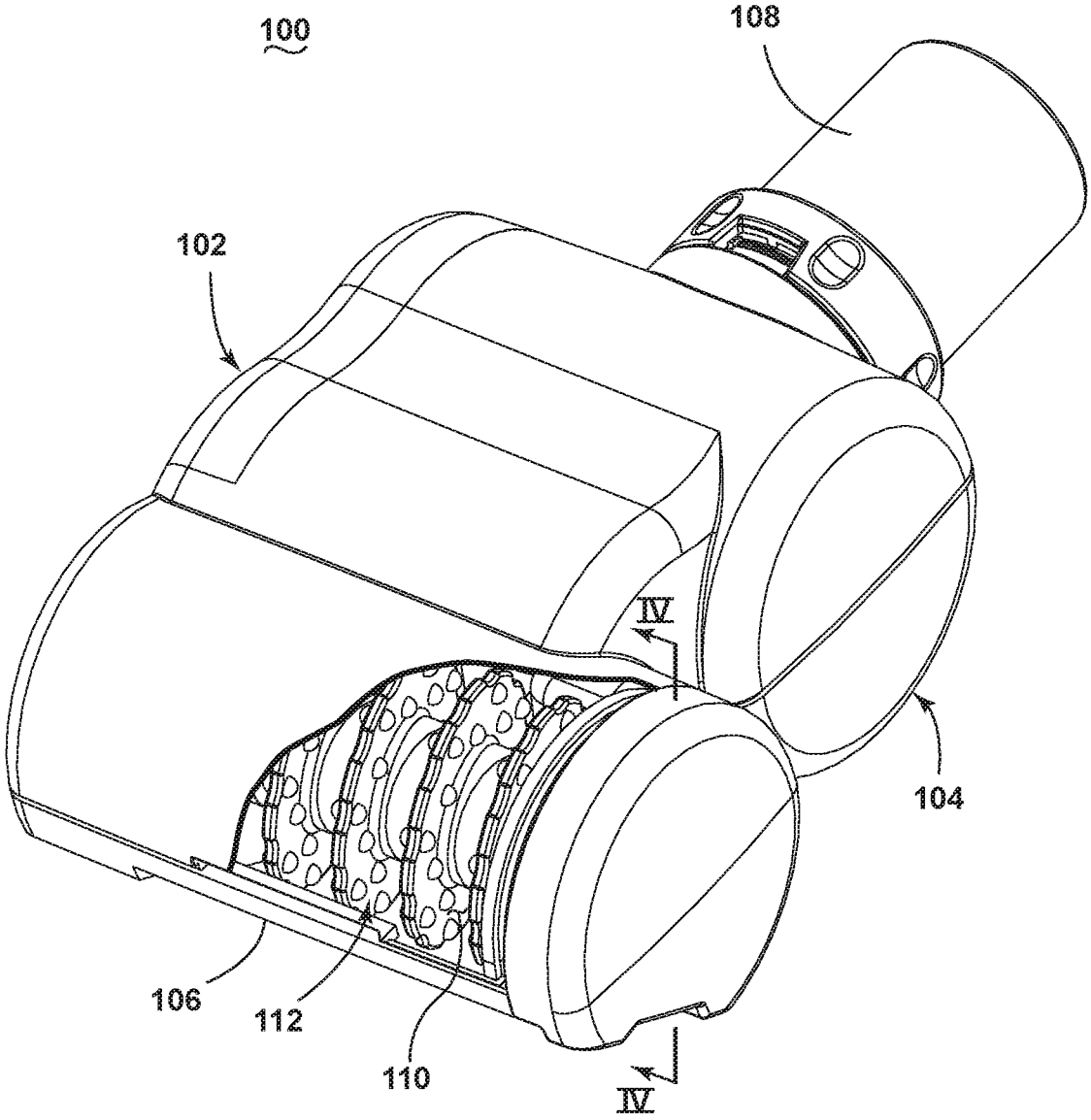
FIG. 2 is a perspective view of a vacuum cleaner tool of FIG. 1, with a portion cut away to show an agitator assembly.

FIG. 2 shows the accessory tool 100 according to a first aspect of the present disclosure. The accessory tool 100 can be used with the vacuum cleaner 10 of FIG. 1. The tool 100 can include a housing containing one or more components of the tool 100; as shown herein, the housing is formed by an upper housing 102 and a lower housing 104. The upper and lower housings 102, 104 can be secured together with mechanical fasteners. Alternatively, the upper and lower housings 102, 104 can be secured together via a removable retaining ring or by other conventional fastening means such as adhesive, ultrasonic welding, or the like. A suction nozzle 106 is formed at a forward, lower portion of the lower housing 104.

The upper housing 102 further comprises a working air conduit 108 positioned on an end of the tool 100 opposite the suction nozzle 106. The suction nozzle 106 communicates with the remote suction source 16 (FIG. 1) via the working air conduit 108 and working air conduit 34. A lower agitator chamber 110 is formed in a forward portion of the lower housing 104 in close proximity to and in fluid communication with the suction nozzle 106. An agitator assembly 112 is rotatably mounted within the agitator chamber 110.

Figure 3:
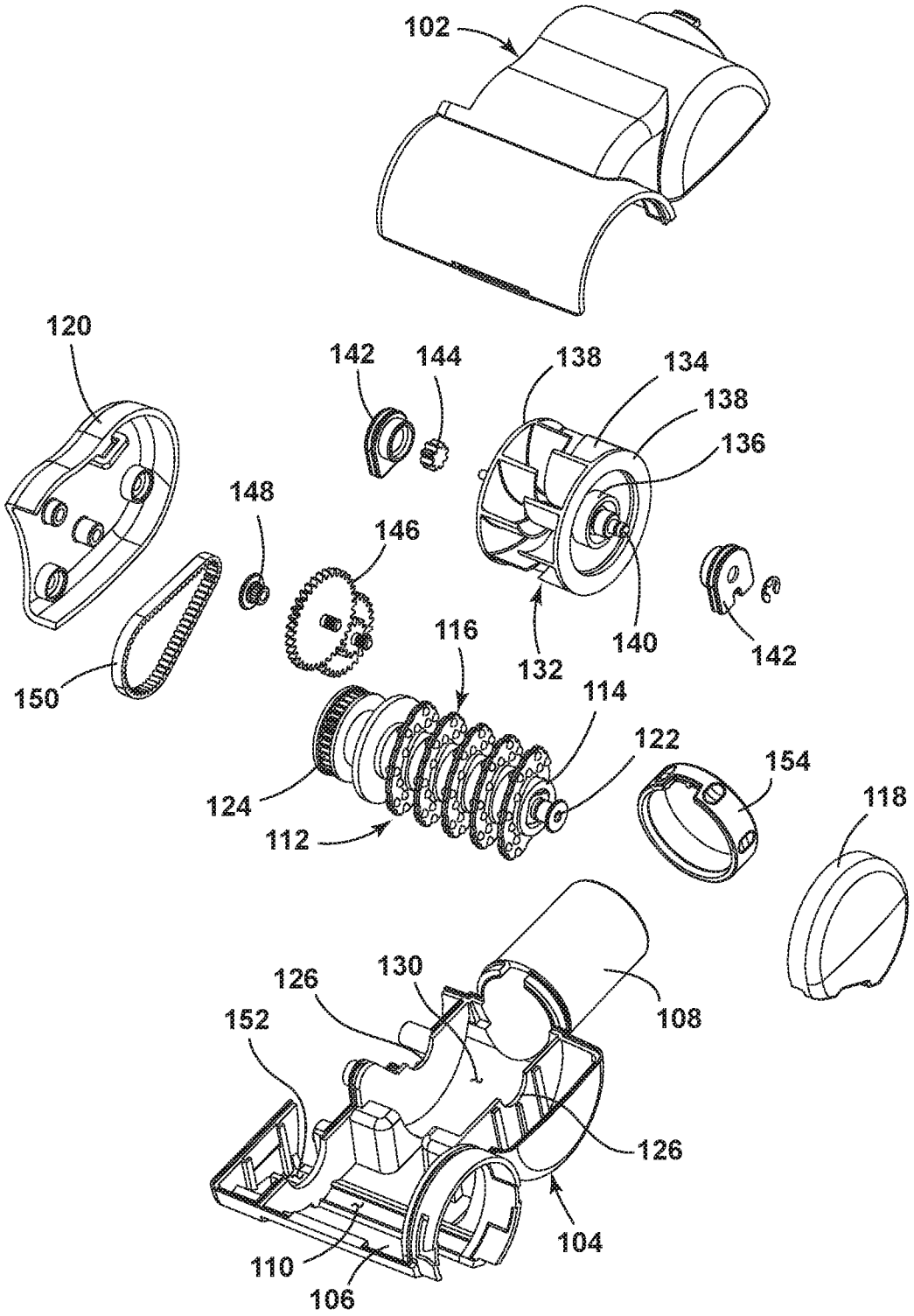
FIG. 3 is an exploded view of the tool shown in FIG. 2.

Referring now to FIG. 3, the agitator assembly 112 includes a dowel 114 that supports an agitating element 116, and is rotatably mounted within the agitator chamber 110 via end cap bearing assemblies 118, 120, which are located on the ends of the dowel 114 and enclose at least a portion of the agitator chamber 110. The cylindrical dowel 114 includes bearing pins 122 fixed at both ends thereof. The bearing pins 122 are rotatably received within the end cap bearing assemblies 118, 120, thus permitting the dowel 114 to rotate about the central axis of the dowel 114 with respect to the agitator chamber 110. The agitator assembly 112 further comprises an agitator pulley 124 formed on the dowel 114 near one end of the dowel 114. The dowel 114 can be molded from a substantially rigid thermoplastic material, such as, but not limited to, ABS (acrylonitrile butadiene styrene) or polypropylene, for example.

An impeller chamber 130 is formed between the suction nozzle 106 and the working air conduit 108 and receives an air-driven turbine or impeller assembly 132. The impeller assembly 132 comprises a plurality of arcuate blades 134 that extend radially outwardly from a central hub 136 between two end walls 138. The blades 134 can be arranged in two sets that are offset from one another so that a blade 134 of one of the sets is positioned between adjacent blades 134 of the other set. Alternatively, the sets of blades 134 can be aligned with each other, or a single set of blades can be provided.

The impeller assembly 132 is mounted on an axle 140 that passes through the hub 136 and defines an axis about which the impeller assembly 132 rotates. The axle 140 is received within opposed bearing assemblies 142 that are mounted to bearing supports 126 formed within the impeller chamber 130 and protruding from the upper and lower housings 102, 104. A drive gear 144 is fixed to one end of the axle 140 and is adapted for cooperative rotation therewith. A gear train 146 having a belt pulley 148 is operably coupled to the drive gear 144 such that rotation of the drive gear 144 rotates the drive belt pulley 148. A drive belt 150 operably connects the belt pulley 148 to the agitator pulley 124 on the agitator assembly 112. The lower housing 104 further comprises a belt compartment 152 formed adjacent the impeller chamber 130 and extending into the agitator chamber 110. The belt compartment 152 is sized to receive the drive belt 150.

In operation, when the blades 134 are exposed to a moving air stream, such as that created by the suction source 16 (FIG. 1), the axle 140 and drive gear 144 rotate with the impeller assembly 132, and induce rotation of the belt pulley 148 via the gear train 146. The drive belt 150 is maintained under tension between the belt pulley 148 and the agitator pulley 124 so that rotation of the belt pulley 148 induces rotation of the drive belt 150 and, thereby, the agitator pulley 124 to rotate the agitator assembly 112.

The upper housing 102 forms a cover to mate with the lower housing 104 and the end cap bearing assemblies 118, 120 mate with the upper and lower housing 102, 104 to enclose the agitator assembly 112, the impeller assembly 132, and the drive belt 150 while also forming an upper surface of a working air path from the suction nozzle 106, through the agitator chamber 110, and through the impeller chamber 130 to the working air conduit 108. The tool 100 may also include a locking collar 154 configured to encircle the air conduit 108 and lock the upper and lower housing 102, 104 together.

While the agitator assembly 112 is shown herein as being driven by the impeller assembly 132, in an alternative aspect, the agitator assembly 112 can be driven by other means. For example, instead of being coupled to the impeller assembly 132 that is driven by the suction source 16, the agitator assembly 112 can be operably interconnected with an electric motor (not shown) provided within the tool 100. The motor can be coupled with the drive belt 150 for imparting rotational movement to the agitator assembly 112. In yet another example, the agitator assembly 112 can be coupled with a mechanical gear train which is turned as the tool 100 is moved on a surface to be cleaned, as is commonly found in mechanical sweepers.

Figure 4:
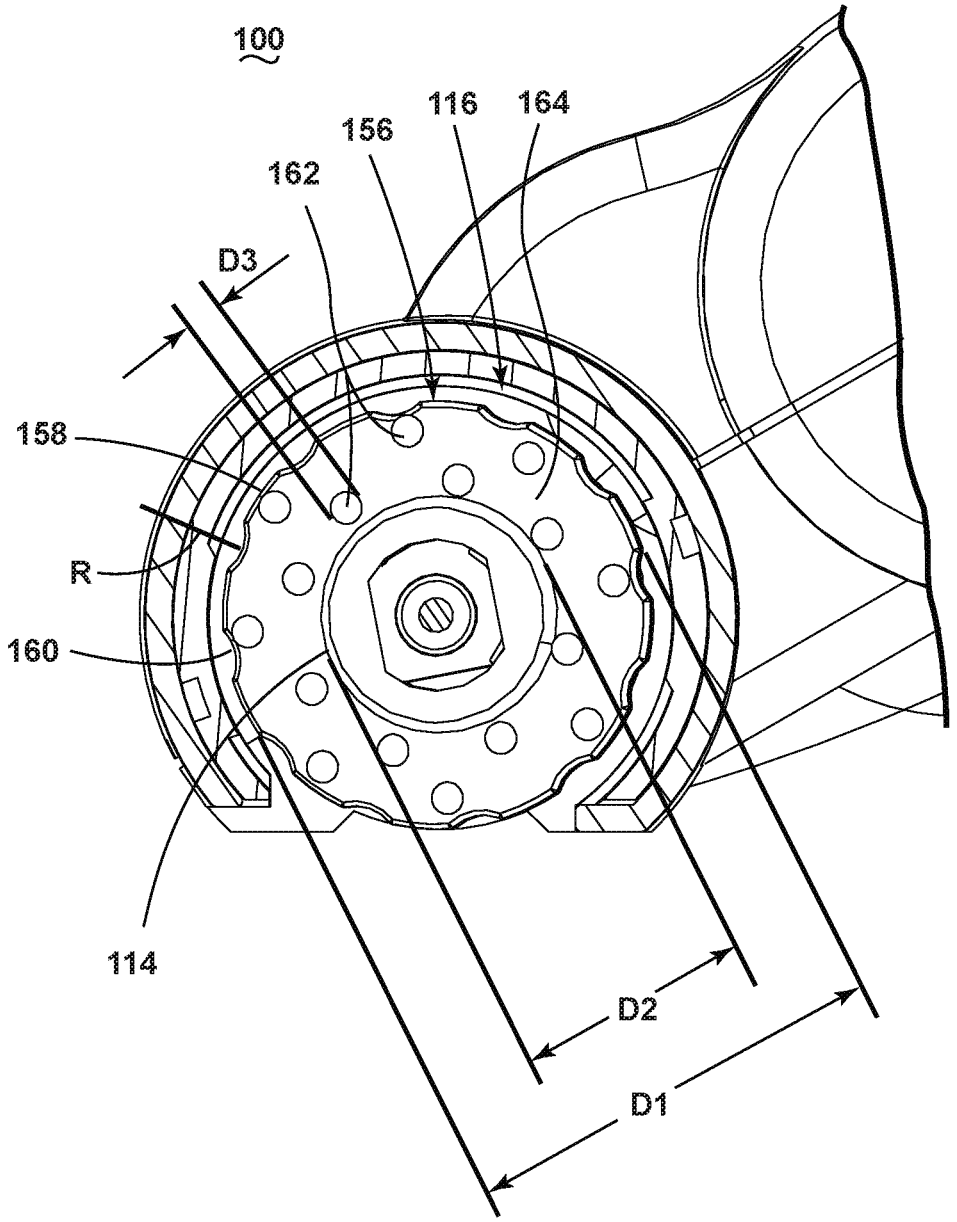
FIG. 4 is a sectional view of the tool taken through line IV-IV of FIG. 2.

FIG. 4 is a sectional view taken along line IV-IV of FIG. 2. The agitating element 116 comprises a plurality of resilient disks 156 spaced axially along and projecting outwardly from the dowel 114. The resilient disks 156 have a diameter "D1" and the dowel 114 has a diameter "D2." In one non-limiting example, the ratio of D1" to "D2" ranges from 1.5:1 to 2.5:1; more specifically, the ratio of "D1" to "D2" can be nominally 2:1.

The resilient disks 156 extend radially from the dowel 114 to a scalloped peripheral edge 158. The scalloped peripheral edge 158 includes a plurality of scallops 160, which are a series of spaced apart, curved recesses extending inwardly toward the dowel 114, and having a radius of curvature "R". In one non-limiting example, the radius of curvature "R" ranges from one quarter of "D2" to three quarters of "D2"; more specifically, the radius of curvature "R" can be nominally equal to half of the dowel diameter "D2".

The resilient disks 156 also include a plurality of nubs 162 projecting outwardly from a disk surface 164 which joins the scalloped peripheral edge 158 to the dowel 114. In one non-limiting example, the nubs 162 are substantially hemispherical-shaped although other geometric shapes are also contemplated. The hemispherical-shaped nubs 162 have a diameter "D3." In one non-limiting example, the ratio of the disk diameter "D1" to the nub diameter "D3" can range from 10:1 to 16:1; more specifically, the ratio "D1" to "D3" can be nominally 13:1.

The plurality of nubs 162 are both spaced apart around the diameter of the disk surface 164 and radially offset along the disk surface 164 from the dowel 114 to the scalloped peripheral edge 158. In one non-limiting example, the plurality of nubs 162 cover between 4% to 20% of the surface area of the disk surface 164; more specifically, the plurality of nubs 162 can nominally cover 12% of the surface area of the disk surface 164.

It will be understood that it is within the scope of the present disclosure to provide resilient disks 156 having either or both nubs 162 and scallops 160.

The material selected for molding the resilient disks 156 can have a relatively higher coefficient of friction and degree of 'tackiness' compared to the material used to mold the dowel 114. A tacky material with a higher coefficient of friction can enhance debris and hair pick up of the resilient disks 156, whereas a dowel 114 molded from a material having a lower coefficient of friction will allow hair to slide off the dowel 114 and reduces the tendency for hair to wrap around the dowel 114. In one non-limiting example, the resilient disks 156 can be molded out of a thermoplastic material having a coefficient of friction between 0.6 to 4.5 and the dowel 114 can be molded out of a material having a coefficient of friction between 0.08 and 0.5, as measured in accordance with ASTM D1894. Some non-limiting examples of thermoplastic elastomer material for the resilient disks 156 include, but are not limited to, a mixture of EPDM (ethylene propylene diene monomer) rubber and polypropylene (i.e. Santoprene™) or silicone. However, other elastomeric materials are contemplated for use in molding the resilient disks 156, such as, but not limited to, rubber, nitrile rubber, and polyurethane. These thermoplastic elastomer and elastomeric materials may be flexible, such that the resilient disks 156 can bend or flex elastically when subjected to normal operational forces but return to substantially its original shape when the normal operational forces are removed.

Figure 5:
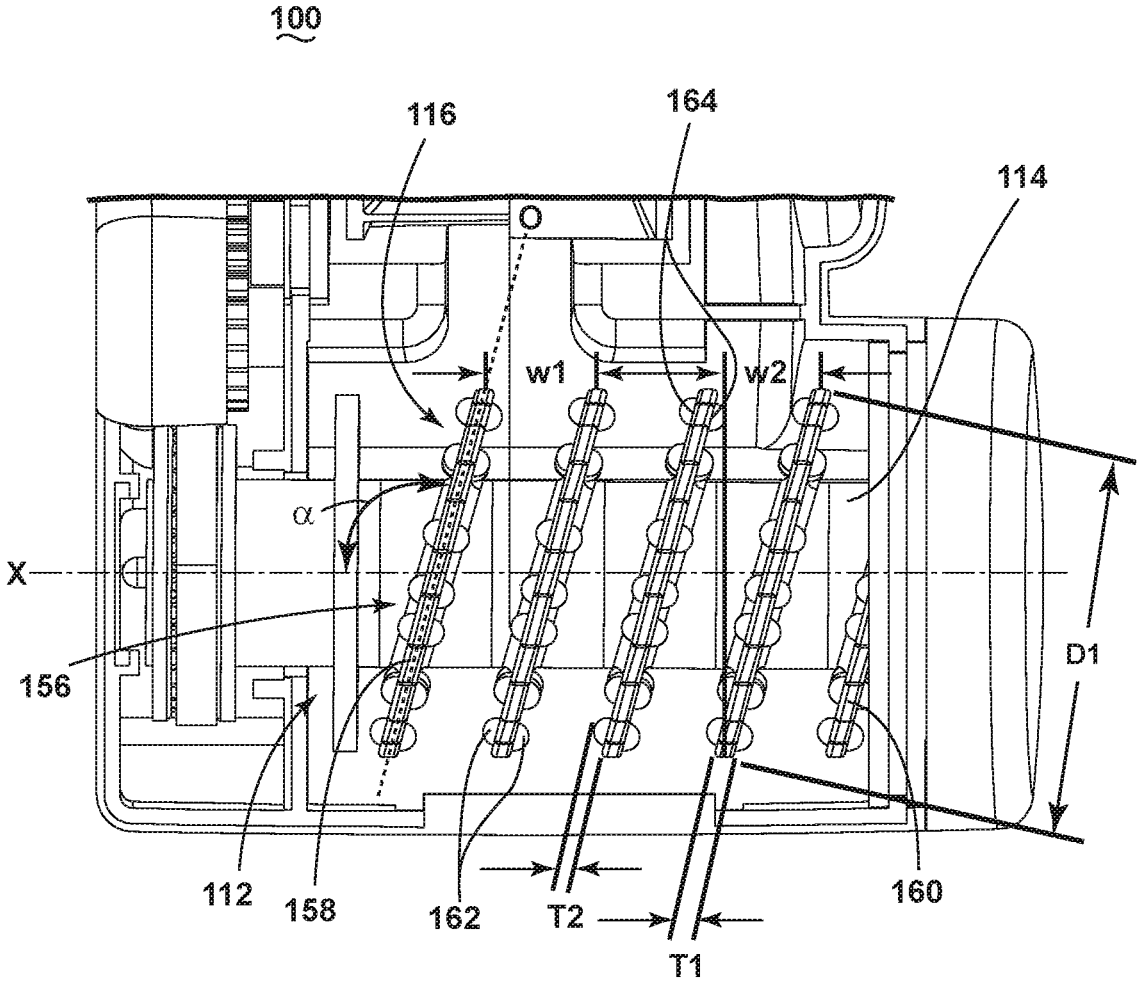
FIG. 5 is a partial top view of the tool from FIG. 2 with the upper housing removed for clarity.

Referring now to FIG. 5, the resilient disks 156 each include a pair of opposing disk surfaces 164 bridged by the scalloped peripheral edge 158. A thickness 'T1" of the resilient disks 156 corresponds to the distance between the opposing disk surfaces 164. One or both of the disk surfaces 164 can be provided with the plurality of hemispherical nubs 162 projecting outwardly therefrom. A thickness "T2" of the nubs 162 corresponds to the distance the nubs 162 project outwardly from the disk surfaces 164. In one non-limiting example, the nub thickness "T2" can be approximately half the nub diameter "D3" (shown in FIG. 4). Further, the ratio of disk thickness "T1" to nub thickness "T2" ranges from 0.66:1 to 2:1; more specifically, the ratio of "T1" to "T2" can be nominally 1.33:1.

In the illustrated aspect, the resilient disks 156 lie in parallel, substantially oblique planes O with respect to the axis of rotation X of the agitator assembly 112. The oblique planes O form angle $\alpha$ with respect to the axis of rotation X wherein the angle α is the maximum angle formed between the oblique planes O of the resilient disks 156 and the axis of rotation X. In one non-limiting example, the angle α ranges from 95° to 125°; more specifically, the angle α can be nominally 110°. The resilient disks 156 are spaced apart on the dowel 114 along the axis of rotation X by a width "W1" to ensure debris and fibers of surface S may pass between the resilient disks 156. The width "W1" corresponds to a width "W2" defined by the width between opposing ends of the scalloped peripheral edge 158 along axis of rotation X. In one non-limiting example, the ratio of "W1" to "W2" ranges from 0.5:1 to 1.5:1; more specifically, the ratio of "W1" to "W2" can be nominally 1:1.

In operation, the tool 100 is fluidly connected to the suction source 16 (FIG. 1) via the working air conduit 108 to draw a working air stream through the suction nozzle 106. A user moves the tool 100 across the surface to be cleaned S. The working air stream flows through the agitator chamber 110, into the impeller chamber 130 and contacts the impeller blades 134, causing the impeller assembly 132 to rotate. The impeller axle 140 rotates within the bearing assemblies 142 and the belt pulley 148 rotates cooperatively with the axle 140. The belt pulley 148 rotates the drive belt 150, which, in turn, engages the agitator pulley 124 and rotates the dowel 114. The agitating element 116 attached to the dowel 114 rotates cooperatively therewith and engages the surface to be cleaned S. The resilient disks 156 swipe in oscillating directions along surface to be cleaned S. The swiping of the resilient disks 156 agitates the surface to be cleaned S and facilitates ingestion of dirt, debris, and hair into the suction nozzle 106, thereby entraining it in the working air stream. Upon entrainment of debris into the working air path, the debris passes through the agitator chamber 110, into the impeller chamber 130 and around the impeller blades 134 and exits the tool 100 through the conduit 108, whereupon the working air passes through the suction hose and into a downstream suction source, where debris can be separated from the working air and collected in a dirt cup or filter bag as is commonly known in the art.

In an operation on a fibrous surface to be cleaned S, such as a carpet or area rug, the scallops 160 displace and/or untangle adjacent fibers on the surface S and also catch and lift debris off the surface S so the debris can be entrained into the working air stream flowing through the suction nozzle 106. The nubs 162 further grab and lift hair or debris from the surface to be cleaned S. The nubs 162 protruding from the disk surface 164 laterally agitate the fibers of the surface S to contact and remove hair or debris embedded therein. The hemispherical shape of the nubs 162 can also prevent the hair or debris from becoming lodged or stuck to the nubs 162 so that it may be ingested into the working air conduit 108.

Figure 6:
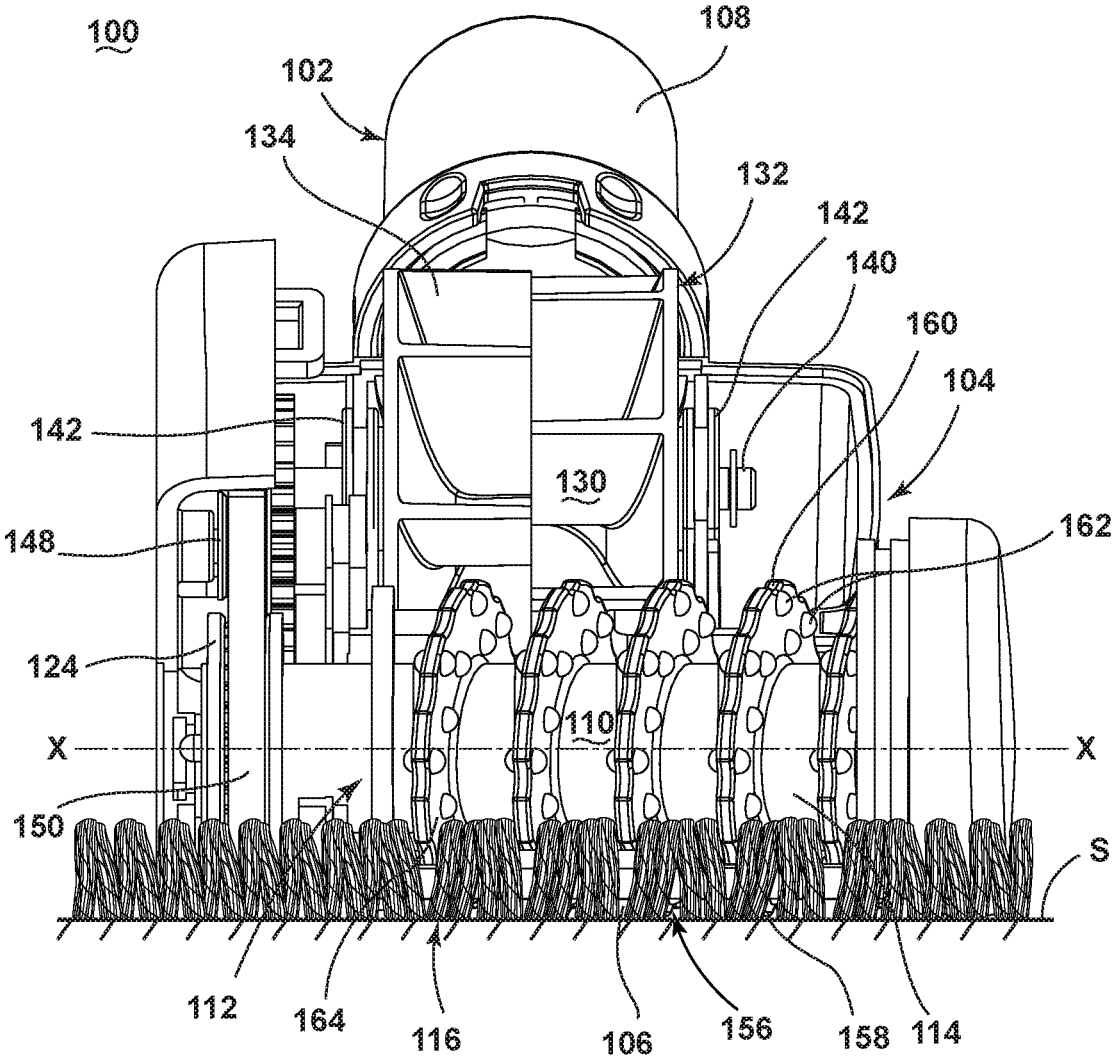
FIG. 6 is a front view of the tool from FIG. 2 with the upper housing removed for clarity and with the agitator in a first position.
Figure 7:
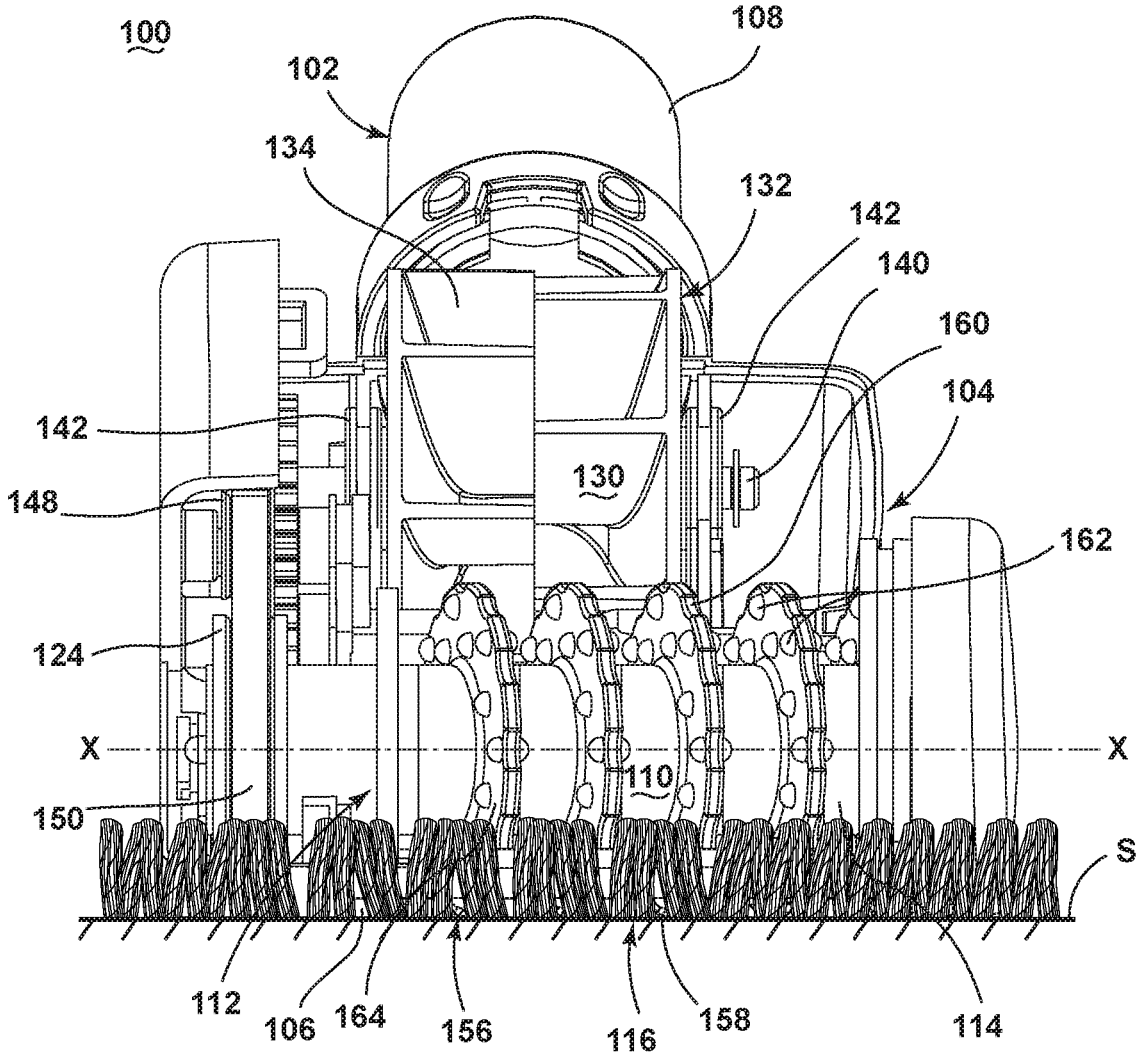
FIG. 7 is a front view of the tool from FIG. 2 with the upper housing removed for clarity and with the agitator in a second position.

Referring now to FIG. 6 and FIG. 7, as the agitator assembly 112 rotates about the axis of rotation X, the resilient disks 156 move between a first position as shown in FIG. 6 to a second position as shown in FIG. 7. The resilient disks 156 move through the first position and second position every 180° of rotation of the agitator assembly 112, oscillating in a side-to-side motion. It is noted that the positions shown in FIGS. 6 and 7 are but two examples, and that the agitator assembly 112 continually rotates through many intermediate positions during its rotation.

As the agitator assembly 112 moves from the first position (FIG. 6) to the second position (FIG. 7), the resilient disks 156 swipe laterally along the surface to be cleaned S in one of a left or right direction with respect to the axis of rotation X. As the agitator assembly 112 moves from the second position (FIG. 7) to the first position (FIG. 6), the resilient disks 156 swipes laterally along the surface to be cleaned S in the other of the left or right direction with respect to the axis of rotation X. As the resilient disks 156 swipe laterally, adjacent carpet fibers are spread apart and hair, dust and debris particles are released and lifted from the surface to be cleaned S and ingested through the suction nozzle 106. When the surface to be cleaned S is a fibrous carpet, the scallops 160 separate and untangle adjacent carpet fibers so the resilient disks 156 can swipe a path through adjacent fibers on the surface S. During the lateral swiping motion and rotation, the scallops 160 and nubs 162 together catch and lift debris and hair off the fibers of the surface S. The scallops 160 and nubs 162 on the resilient disks 156 catch and lift hair and debris into the suction nozzle 106 thereby preventing the hair or debris from wrapping around the dowel 114 and subsequently jamming the agitator bearing assemblies 142 or enshrouding the agitating element 116.

Figure 8A:
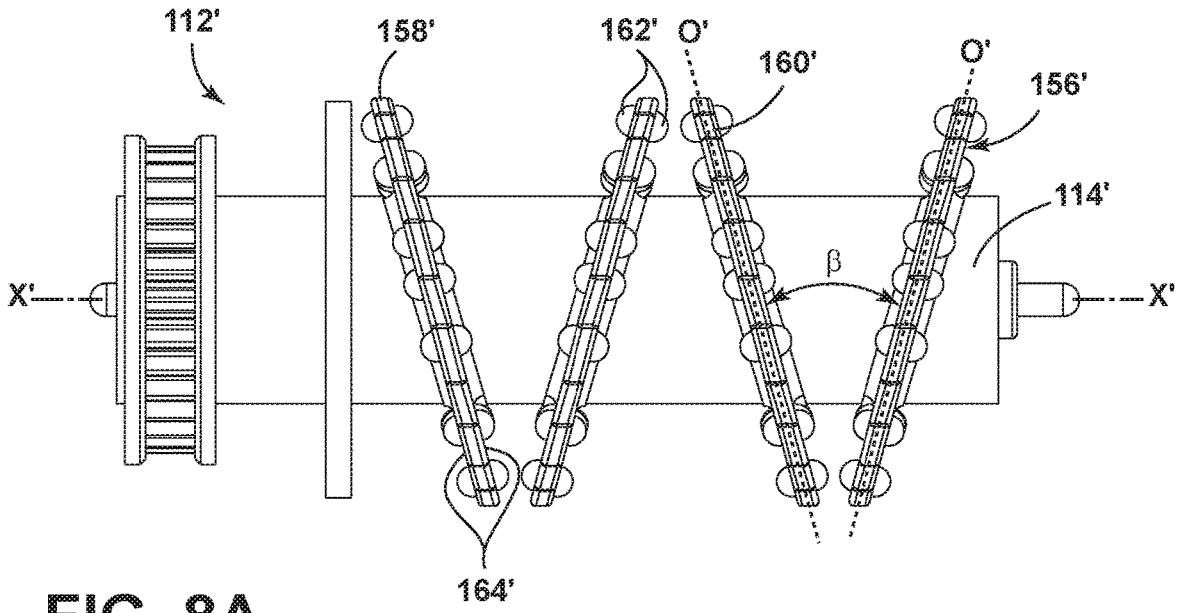
FIG. 8A is a front view of an agitator assembly according to an aspect of the present disclosure.
Figure 8B:
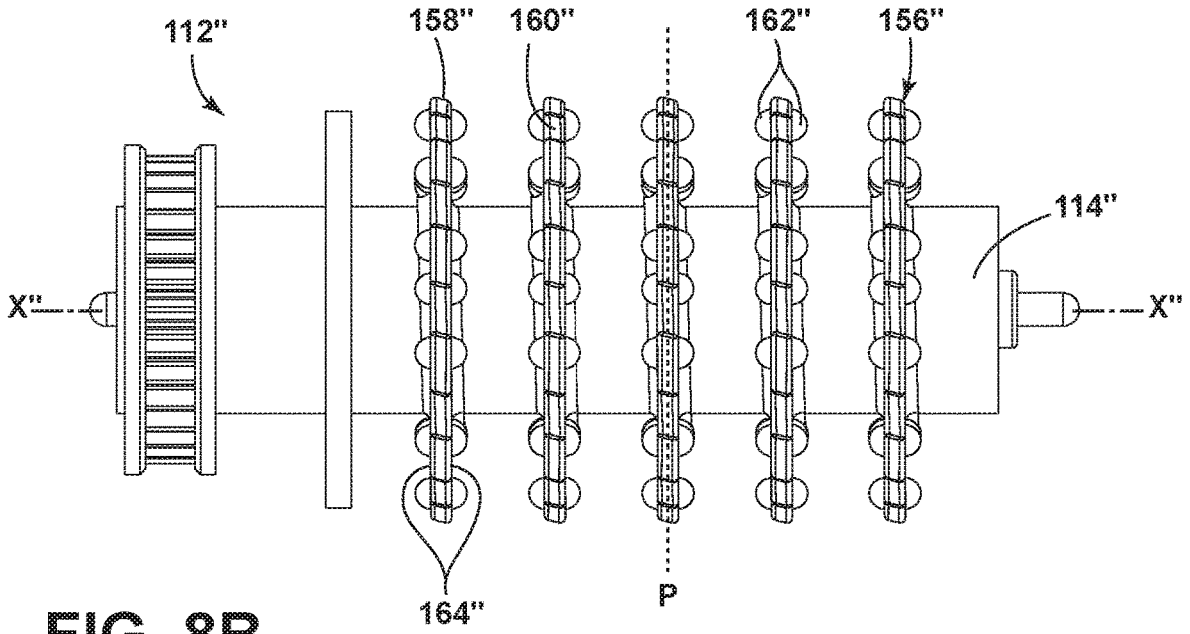
FIG. 8B is a front view of an agitator assembly according to an aspect of the present disclosure.

FIGS. 8A-8B show some alternative aspects of the agitator assembly 112. It is understood that the agitator assemblies shown can be used with the vacuum cleaner 10 and/or tool 100 described above.

Referring to FIG. 8A, in another aspect of the present disclosure where like elements from the previous aspects of the present disclosure are identified with the same reference numerals and include a prime (') symbol, the agitator assembly 112' includes resilient disks 156' which each lie in oblique planes O1', O2' with respect to the axis of rotation X' wherein oblique planes O1', O2' of adjacent resilient disks 156' are not parallel. The oblique planes O1' and O2' of adjacent resilient disks 156' are arranged such that an acute angle β is formed there between. During rotation of the agitator assembly 112', adjacent resilient disks 156' swipe laterally along a surface to be cleaned in opposite directions with respect to the axis of rotation X'.

Referring to FIG. 8B, in yet another aspect of the present disclosure where like elements from the previous aspects of the present disclosure are identified with the same reference numerals and include a double prime (") symbol, the agitator assembly 112" includes resilient disks 156" which each lie in transverse planes P which are perpendicular to the axis of rotation X". During rotation of the agitator assembly 112", the scallops 160" and nubs" help to form a path in the fibrous carpet and to release, catch and lift hair or debris within the fibrous carpet.

While the aspects of the present disclosure have been specifically described in connection with certain specific aspects thereof, it is to be understood that this is by way of illustration and not of limitation. Reasonable variation and modification are possible within the scope of the foregoing description and drawings without departing from the scope of the present disclosure, which is described in the appended claims.

What is claimed is:

1. An agitator for a surface cleaning apparatus, comprising:

a dowel defining an axis of rotation; and a plurality of disks extending radially from the dowel to an outer periphery having a scalloped peripheral edge, the scalloped peripheral edge including a series of curved recesses extending inwardly toward the dowel to define a series of concave curved recesses on the outer periphery and wherein the plurality of disks lie in oblique planes with respect to the axis of rotation.

2. The agitator of claim 1 wherein the series of concave curved recesses are spaced apart from one another.

3. The agitator of claim 1 wherein scallops of the scalloped peripheral edge have a radius of curvature that ranges from ¼ to ¾ of the diameter of the dowel.

4. The agitator of claim 1 wherein at least one of the plurality of disks includes a pair of opposing disk surfaces bridged by the scalloped peripheral edge, and further comprising a plurality of nubs projecting from at least one disk surface of the pair of opposing disk surfaces.

5. The agitator of claim 4 wherein the distance between the pair of opposing disk surfaces defines a thickness T1 and the distance the nubs project from the at least one disk surface defines a thickness T2, and wherein the ratio of T1 to T2 ranges from 0.66:1 to 2:1.

6. The agitator of claim 1 wherein a ratio of a diameter of the plurality of disks to a diameter of the dowel ranges from 1.5:1 to 2.5:1.

7. The agitator of claim 1 wherein the oblique planes of the plurality of disks are parallel to each other.

8. The agitator of claim 7, wherein the oblique planes form angle $\alpha$ with respect to the axis of rotation that ranges from 950 to 125°, wherein the angle $\alpha$ is the maximum angle formed between the oblique planes of the plurality of disks and the axis of rotation.

9. The agitator of claim 1, wherein the plurality of disks are spaced apart on the dowel along the axis of rotation by a width W1 and opposing ends of the scalloped peripheral edge are spaced apart along the axis of rotation by a width W2, and wherein the ratio of W1 to W2 ranges from 0.5:1 to 1.5:1.

10. The agitator of claim 1 wherein the oblique planes of at least two adjacent disks of the plurality of disks are not parallel to each other.

11. The agitator of claim 10 wherein the oblique planes of the at least two adjacent disks of the plurality of disks form an acute angle therebetween.

12. The agitator of claim 1 wherein the plurality of disks have a higher coefficient of friction than the dowel.

13. The agitator of claim 1 wherein the plurality of disks are molded out of a thermoplastic material having a coefficient of friction between 0.6 to 4.5 and the dowel is molded out of a material having a coefficient of friction between 0.08 and 0.5.

14. An agitator for a surface cleaning apparatus, comprising:

a dowel defining an axis of rotation; and a plurality of disks extending radially from the dowel to a scalloped peripheral edge, the scalloped peripheral edge including a series of curved recesses extending inwardly toward the dowel, wherein the plurality of disks have a higher coefficient of friction than the dowel.

15. The agitator of claim 14 wherein the plurality of disks lie in oblique planes with respect to the axis of rotation.

16. The agitator of claim 15 wherein the plurality of disks lie in transverse planes which are perpendicular to the axis of rotation.

17. The agitator of claim 14 wherein the curved recesses are spaced apart from one another.

18. The agitator of claim 17 wherein the scalloped peripheral edge includes a plurality of scallops that define the series of spaced apart, curved recesses extending inwardly toward the dowel.

19. The agitator of claim 18 wherein the scallops have a radius of curvature that ranges from ¼ to ¾ of the diameter of the dowel.

20. An agitator for a surface cleaning apparatus, comprising:

a dowel defining an axis of rotation; and a plurality of disks extending radially from the dowel to an outer periphery having a scalloped peripheral edge, the scalloped peripheral edge including a series of curved recesses extending inwardly toward the dowel to define a series of concave curved recesses on the outer periphery, wherein the plurality of disks lie in oblique planes with respect to the axis of rotation and wherein at least one of: the plurality of disks have a higher coefficient of friction than the dowel or the plurality of disks each include a pair of opposing disk surfaces bridged by the scalloped peripheral edge and a plurality of nubs projecting from at least one disk surface of the pair of opposing disk surfaces.

* * * * *